US005090649A

United States Patent [19]

Tipp

[11] Patent Number: 5,090,649

[45] Date of Patent: Feb. 25, 1992

[54] PORTABLE SUPPORT FOR CURLING IRON

[76] Inventor: Charles S. Tipp, 6427 Quarry La., Dublin, Ohio 43017

[21] Appl. No.: 499,714

[22] Filed: Mar. 27, 1990

[51] Int. Cl.[5] ..... F16M 11/00

[52] U.S. Cl. ..... 248/176; 248/117.3; 219/242

[58] Field of Search ..... 248/176, 117.1-117.5; 219/242

[56] References Cited

U.S. PATENT DOCUMENTS

| | | | |
|---|---|---|---|
| D. 305,944 | 2/1990 | Mellott . | |
| 1,502,385 | 7/1924 | Hauenstein | 248/176 X |
| 2,169,965 | 8/1939 | Neidermaier . | |
| 3,215,815 | 11/1965 | Lerner | 248/176 X |
| 3,294,348 | 12/1966 | Cerisano . | |
| 3,964,708 | 6/1976 | Reeves . | |
| 4,093,171 | 6/1978 | Mengo, Sr. . | |
| 4,103,145 | 7/1978 | Oliveri . | |
| 4,159,096 | 6/1979 | Chase . | |
| 4,308,878 | 1/1982 | Silva . | |
| 4,456,816 | 6/1984 | Fortune . | |
| 4,662,022 | 5/1987 | Vogler . | |

FOREIGN PATENT DOCUMENTS 2042326 9/1980 United Kingdom .

*Primary Examiner*—Alvin C. Chin-Shue

*Attorney, Agent, or Firm*—Vorys, Sater, Seymour & Pease

[57] ABSTRACT

A portable stand for a curling iron is disclosed which incorporates in an integral body, a portable base body, a cylindrical holder and heat resistant and air cooling structure together with a shape and size which provides for stability of the stand when holding the curling iron.

3 Claims, 1 Drawing Sheet

PORTABLE SUPPORT FOR CURLING IRON

CROSS REFERENCE TO RELATED APPLICATION

This application is related to a copending design application 07/499,672 entitled, "Stand for Handheld Curling Iron or Similar Article" which is being filed concurrently herewith.

BACKGROUND OF THE INVENTION

The present invention is related to storage and support devices for handheld articles having electrically heated elements and, more particularly, to a stand for a hair curling iron, hair curling brush or the like.

Some home health and beauty appliances, such as hair curling irons have electric heating elements. After used, these appliances are, however, generally placed on counter or storage spaces where there is a possibility of them being inadvertently knocked from the counter and consequently damaged. Moreover, there is the fact that the heating element associated with the curling iron must cool so as to allow placing it on a counter space or the like. Furthermore, a curling iron is typically heated to temperatures of about 200° F. in order to function properly. Known curling irons, however, are cooled by exposure to ambient air. Consequently, time is a requirement for the heating element to cool before it can be left unattended. This can be a considerable drawback for persons who are rushed for time. In addition, there are the possibilities of heated curling irons falling from their supporting surface and striking heat combustible materials or even being touched by the user or a child with resulting flesh burns or the like. Moreover, from an aesthetic and convenience standpoint it is desireable to have the curling iron neatly and easily stored. Also significant is the desire to produce such a device in a simple and economical manner.

There have been a number of prior approaches in this field, such as shown and described in the following U.S. Pat. Nos.: 3,964,708; 4,103,145; 4,308,878 and Des. 305,944.

SUMMARY OF THE INVENTION

The present invention provides an improved storage device or stand for hair curling irons, hair curling brushes or similar devices. In accordance with the present invention, there is provided a portable apparatus for storing a handheld beauty device, such as a curling iron having an elongated electric heating element. Included in the apparatus is a portable base body. Provision is made for means coupled to the base body for removably mounting and storing at least a portion of the heating element of the handheld device. The storing means defines a generally tubular cylindrical holding member having a generally cylindrical cavity with at least one open end thereof for allowing insertion and removal of the heating element of the handheld device. Provision is made for plurality of spaced apart internally disposed heat resistant means in the holding member which are arranged to be contacted by portions of the heating element. The cylindrical holding member includes an end piece provided with openings allowing air passage relative to the heating element for cooling of the same.

In one illustrated embodiment, one of the heat resistant means is positioned adjacent the open end portion of the holder and another one of the heat resistant means is positioned adjacent the end piece.

In another illustrated embodiment, the heat resistant means includes a plurality of circumferentially spaced internal ribs which are made of a heat resistant material.

In another illustrated embodiment, the end piece is made of the heat resistant material.

In another illustrated embodiment, the cylindrical holder is constructed and mounted in such a manner as to provide stability for the stand especially when holding the curling iron.

Among the other objects and feature of the present invention are provisions for an improved stand or storage device for a curling iron or similar article; the provision for an improved curling iron stand which has improved heat resistant features; the provision for an improved curling iron stand of the last noted type which has improved air circulation structure; the provision of an improved curling iron stand which is highly stable; and the provision of an improved curling iron stand which is simple and economical to manufacture.

Still other objects and further scope of applicability of the present invention will become apparent from the detailed description to follow when taken in conjunction with the accompanying drawings in which like parts are designated by like reference numerals throughout the several views.

DETAILED DESCRIPTION

Figure 1:
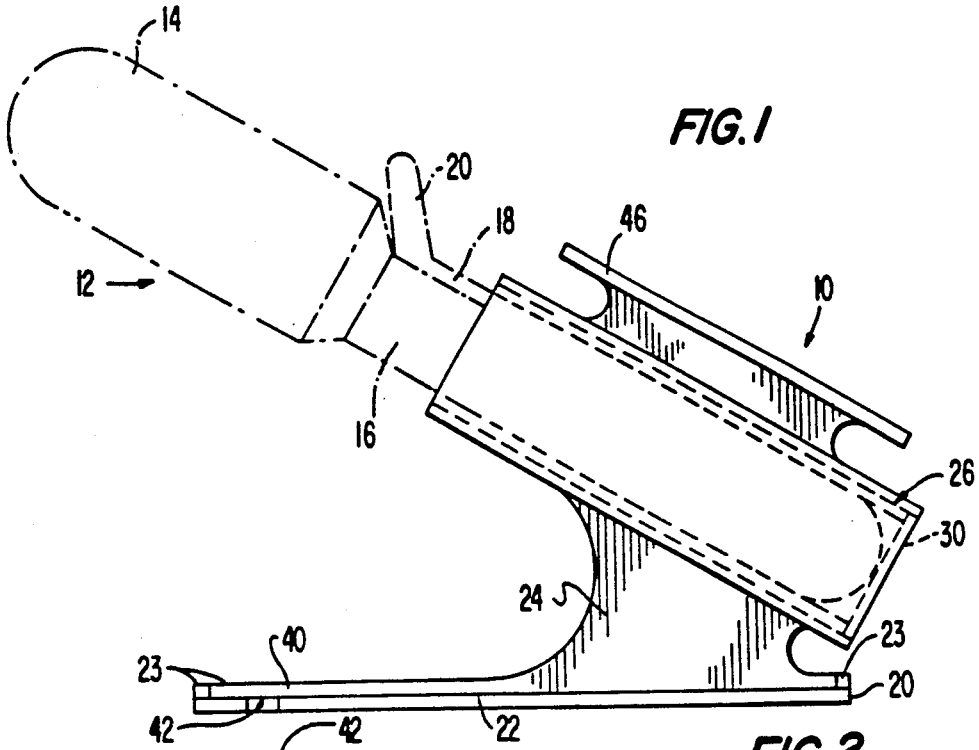
FIG. 1 is an elevational view of one embodiment of the portable stand of the present invention.

The present embodiment is directed to a portable storing stand 10 for a conventional hair curling iron 12 represented by phantom lines. The hair curling iron 12 includes a suitable plastic handle 14 and extending from the latter an electric heating curling iron element 16 and a hair clamp piece 18 which is connected to a thumb piece 20. The present embodiment discusses use of the present invention with a hair curling iron 12, however, the portable storing stand 10 can be used for other handheld beauty devices as well; such as hair curling brushes.

Figure 2:
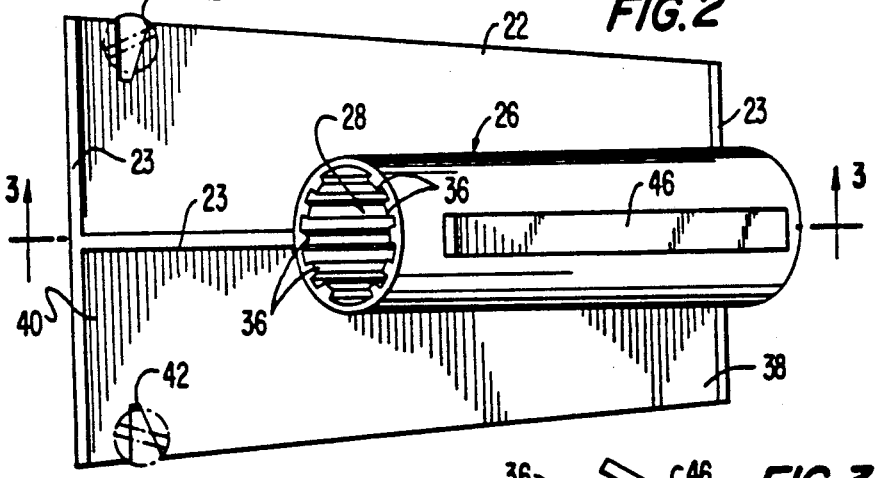
FIG. 2 is a plan view of the portable stand of the present invention.
Figure 4:
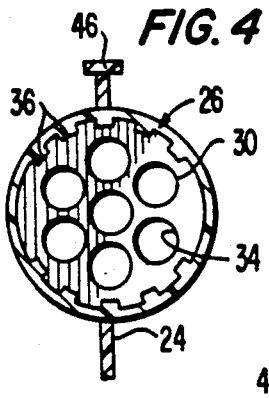
FIG. 4 is a cross-sectional view taken along section-line 4—4 appearing in FIG. 3.
Figure 3:
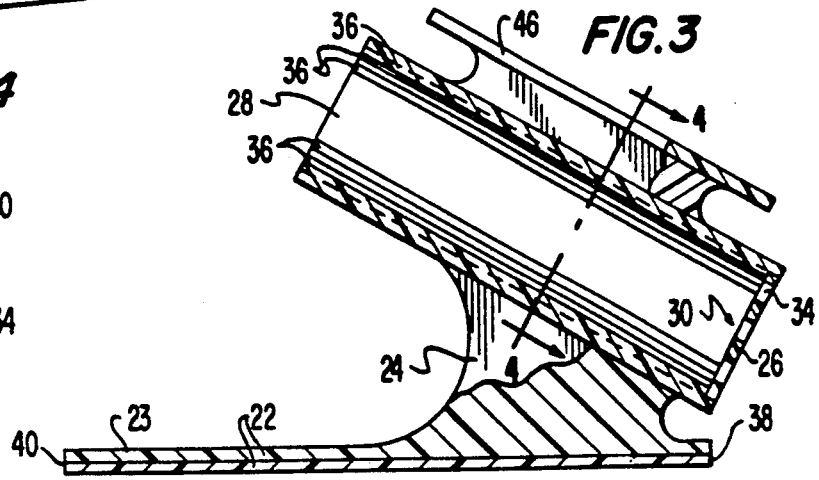
FIG. 3 is a cross-sectional view of the present invention taken along section-line 3—3 appearing in FIG. 2.

FIGS. 1–4 illustrate the portable hair curling iron storing stand 10. The stand 10 includes a generally rectangular flat baseplate 22 having a pedestal 24 for mounting a cylindrically tubular curling iron holder 26 having an open end portion 28 and an opposite closed end portion 30. The baseplate 22 is provided with reinforcing ribs 23 for strength and stability. The closed end 30 is defined by an end plate 32 having air apertures 34. The apertures 34 permit air circulation passed the heating element 16 for cooling purposes. Longitudinally extending along the axial extent of the holder 26 are an upper and lower groupings of heat resistant fins 36. The heat resistant fins 36 are spaced circumferentially about diametrically opposed, upper and lower, portions of the inner periphery of the cylindrical holder 26. The heat resistant fins 36 are adapted to be contacted by proximal and distal end portions of the heating element 16. It will be understood that a wide variety of heat resistant materials can be used, preferably so long as there is minimal or no degradation caused by the curling iron. The fins 36 are made of a heat resistant plastic material, such as acrylic. Also, the end plate 32 can be made of the same heat resistant material. While in this embodiment, the heat resistant fins 36 run the longitudinal extent of the holder 26, it will be appreciated that the fins can be located only at heatable zones, whereat there would be a tendency for the electrical element 16 to engage the latter. The fins 36 are circumferentially spaced to allow passage of the air for cooling purposes. The fins 36 can also extend circumferentially around the entire inner periphery of the holder 28. Also, for hair curling brushes, the brushes can slide between the fins 36. With continued reference to the holder 26, it is preferably made of the same material as the heat fins 36 for purposes of economy of manufacture. Accordingly, there is provided a stand for curling iron which provides for heat resistance and improved air circulation in a simple single piece structure.

For the purpose of providing stability for the portable storing stand 10, the holder 26 is mounted on the pedestal 24 and the holder 26 is oriented at an angle and mounted on the baseplate 22 such that the center of gravity of the stand 10, especially with the curling iron 12 held therein, is spaced near the rearward end 38 of the baseplate. This provides for considerable stability especially if the forward end 40 of the baseplate 22 extends beyond a counter edge (not shown) so as to minimize the likelihood of it falling from the counter. Additionally, the baseplate 22 is provided with slots 42 so that the baseplate can be fixedly mounted to the support surface by screws or the like. Also, a handle 46 is attached to the top end of the holder 26 and facilitates a cord of the appliance being wrapped thereabout as well as carrying of the stand 10. In addition, the handle and the pedestal serve to transfer heat and the handle allows the stand to be carried while the stand is heated.

Since certain changes may be made in the above described apparatus without departing from the scope of the invention herein involved, it is intended that all matter contained in this description as shown in the accompanying drawings shall be interpreted as illustrative and not in a limiting sense.

I claim:

1. An apparatus for storing a handheld beauty device having a heatable electrical element, comprising:

a portable base body;

means coupled to said base body for removably mounting and storing at least a portion of the heating element of the handheld device;

said storing means defines a generally tubular holding member having a cavity with at least one open end portion thereof for the insertion and removal of the heating element of the handheld device;

a plurality of spaced apart internally disposed heat resistant means in said holding member which are arranged in at least heatable zones to be contacted by portions of the heating element when received within said holding member;

said holding member includes an end piece provided with openings allowing air passage relative to the heating element for cooling of the same wherein said holding member is made of a heat resistant material;

one of said heatable zones of said heat resistant means is positioned adjacent said open end portion and another one of said heatable zones of said heat resistant means is positioned adjacent said end piece so that proximal and distal end portions of the heating element engage said heat resistant means; and, said holding member is constructed and mounted to said base body in such a manner as to provide stability for the apparatus especially when holding the curling element, said base body includes a baseplate and a pedestal oriented at an angle on said baseplate such that a center of gravity of said apparatus is near a rearward end of said baseplate so as to provide stability for said apparatus wherein said heat resistant means includes a plurality of circumferentially spaced internal ribs which are made of a heat resistant material and which extend along the length of said holding member.

2. The apparatus of claim 1 wherein said holding member includes a handle attached thereto which facilitates transfer of said apparatus while heated.

3. The apparatus of claim 1 which is made of a single heat-resistant plastic material.

* * * * *